US005154583A

United States Patent [19]

Althaus et al.

[11] Patent Number: 5,154,583

[45] Date of Patent: Oct. 13, 1992

[54] ROTOR OF A PRESSURE WAVE MACHINE

[75] Inventors: Rolf Althaus, St. Gallen; Yau-Pin Chyou, Wettingen; Erwin Zauner, Baden, all of Switzerland

[73] Assignee: Asea Brown Boveri Ltd., Baden, Switzerland

[21] Appl. No.: 749,715

[22] Filed: Aug. 26, 1991

[30] Foreign Application Priority Data

Aug. 25, 1990 [EP] European Pat. Off. ..... 90116313.9

[51] Int. Cl.[5] ..... F04F 11/02

[52] U.S. Cl. ..... 417/64

[58] Field of Search ..... 417/64; 60/39.45 A; 123/559.2

[56] References Cited

U.S. PATENT DOCUMENTS 2,440,865 5/1948 Lynch et al. ..... 417/64
2,537,344 1/1951 Gruss .
2,766,928 10/1956 Jendrassie ..... 417/64
3,101,168 8/1963 Berchtold ..... 417/64

FOREIGN PATENT DOCUMENTS 955557 1/1957 Fed. Rep. of Germany ..... 417/64
405827 7/1966 Switzerland .
594086 11/1947 United Kingdom .

*Primary Examiner*—Leonard E. Smith
*Attorney, Agent, or Firm*—Burns, Doane, Swecker & Mathis

[57] ABSTRACT

In a rotor of a pressure wave machine, rotor cells (2) are evenly distributed at its periphery, these rotor cells being intended to accept two gaseous media during operation for the purpose of compressing the first by means of pressure waves of the second medium. The rotor cells are arranged in such a way that they extend in a plane normal to the axis of rotation of the rotor (1).

2 Claims, 1 Drawing Sheet

ROTOR OF A PRESSURE WAVE MACHINE

BACKGROUND OF THE INVENTION

1. Field of the Invention

The present invention concerns a rotor of a pressure wave machine in accordance with the preamble.

2. Discussion of Background

In pressure wave machines, when they are used as the supercharging unit for internal combustion engines, ambient air is compressed to boost air; when they are used as the high pressure compressor stage of a gas turbine, precompressed air is further compressed to produce driving gas for the high pressure turbine part. The compression of the air takes place in a rotor whose periphery has cells, which in present-day designs run parallel to the axis, in which cells the air comes into direct contact, without any solid separating element, with the exhaust gas from the engine or with driving gas branched off from the combustion chamber of the turbine group. In order to control the inlets and outlets of air and gas into or out of the cells, a casing with ports for the supply and/or removal of the two media participating in the pressure wave process is located at the two end faces of the rotor. If a cell filled with air which has to be compressed passes in front of a high pressure gas inlet, a pressure wave propagates into the cell where it compresses the air. This pressure wave reaches the end of the cell as soon as the latter passes the high pressure air outlet. At this point, the air is expelled and the cell is then completely filled with gas. On further rotation, expansion waves ensure that the gas leaves the cell again and that fresh air is induced, whereupon the compression process is repeated.

A critical circumstance, which is also decisive for the pressure wave machine process, consists in the fact that the dimensions of the cells cannot be arbitrarily increased without influencing the pressure wave machine process and that, for machines with different power, rotors with different diameters have to be provided in each case.

SUMMARY OF THE INVENTION

The object of this invention, as characterized in the claims, is to provide the cells in a rotor of a pressure wave machine of the type described at the beginning in such a way that they can be arbitrarily enlarged without influencing a process taking place in the pressure wave machine.

The essential advantage of the invention may be seen in the fact that the mixing processes on the opening of the cell and in consequence of the Coriolis forces take place in the same plane. The dimensions of the cell therefore only have to be kept small in the peripheral direction whereas, in the axial direction, there is no limitation to the dimensions of the cells. In consequence, the frictional resistance and the heat transfer can be reduced relative to an approximately square cell. In addition, machines with different powers can be manufactured simply by changing the rotor length at the same diameter.

A further advantage of the invention may be seen in the fact that it is possible for individual phases of the process to compensate completely or partially, by appropriate curvature of the cells in the peripheral direction, for the Coriolis forces, inter alia, which occur due to the radial motion in a rotating system.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
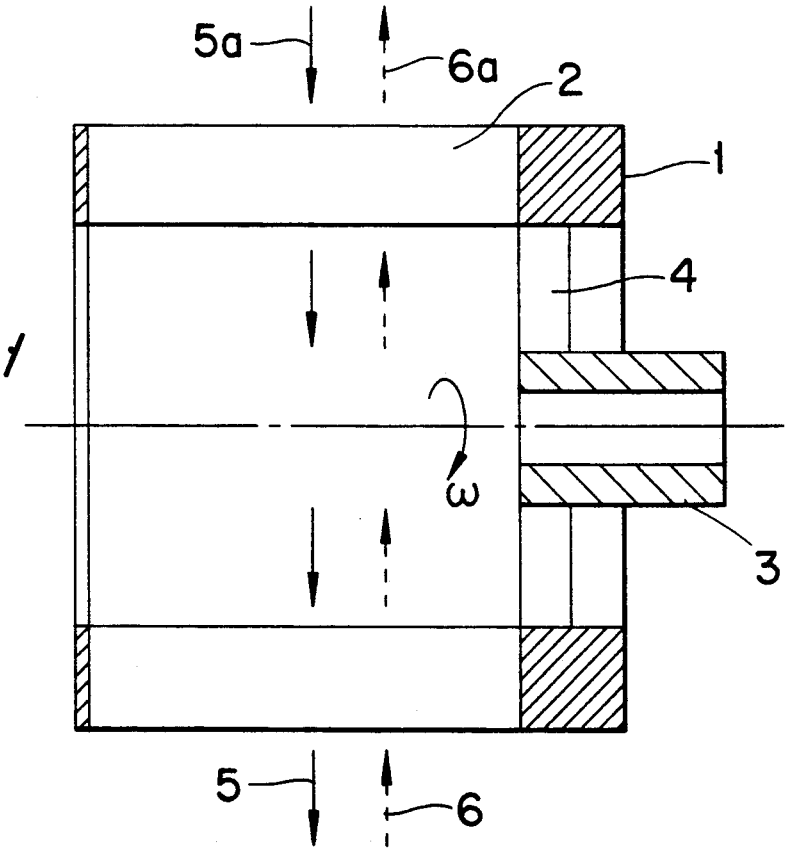
FIG. 1 shows a cell rotor in cross-section.

Referring now to the drawings, wherein like reference numerals designate identical or corresponding parts throughout the several views, in which the direction of the media is indicated by arrows and in which all elements not necessary for immediate understanding of the invention are omitted, FIG. 1 shows a cell rotor 1 which consists of a hollow inner part and which carries rotor cells 2 in a plane normal to the axis of rotation of the cell rotor 1. On one side, the rotor body carries a hub 3 which has a bore hole for cooling or throughflow reasons. This hub 3 is connected to the axial physical boundary of the cells 2 by means of a number of connecting elements 4. The inflow 5 or 5*a* and the outflow 6 or 6*a* of the media therefore also occur normal to the axis of rotation of the cell rotor 1. This configuration has the effect that the mixing processes on the opening of the cell and in consequence of the Coriolis forces occurring due to the arrangement of the rotor cells 2 can take place in the same plane, which acts preferentially in a very advantageous manner for an energy exchange process. Because of this fact, the dimensions of the rotor cells therefore only have to be kept small in the peripheral direction whereas, in the axial direction, there is no limitation to the dimensions of the rotor cells. In consequence, the frictional resistance and the heat transfer can be reduced relative to an approximately square cell corresponding to the state of the art. Machines of different power can therefore be covered simply by changing the length of the cell rotor 1 without changing the diameter at all. This makes it possible to develop a more compact range of designs, and the possibilities for the application of this cell rotor 1 increase disproportionately because, in most cases, an increase in the diameter of the cell rotor 1 involves insuperable structural difficulties. Reference should be made to the comments under FIG. 2 for the geometrical design of the connecting elements 4.

Figure 2:
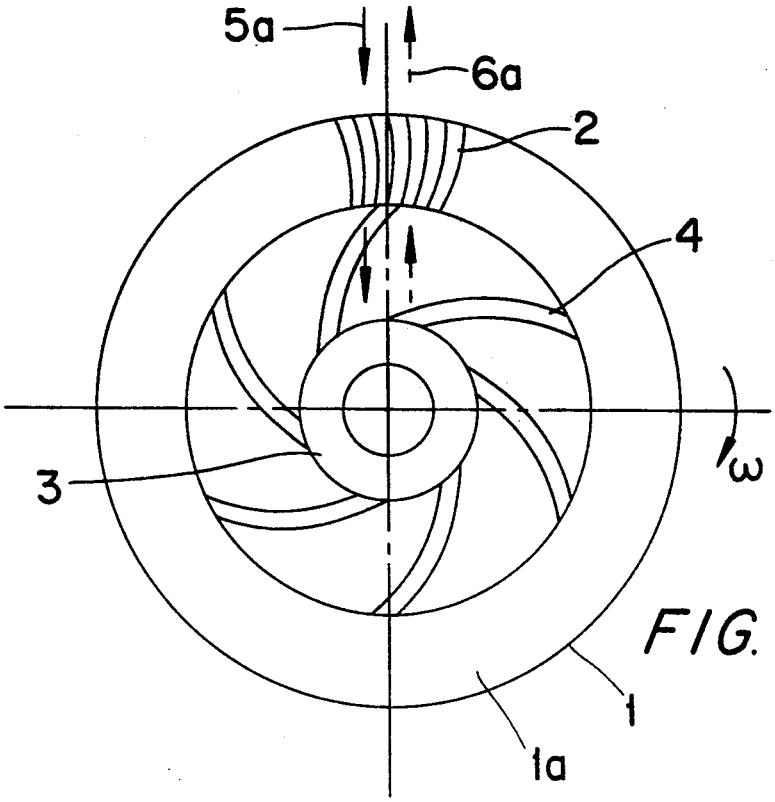
FIG. 2 shows a side view of the cell rotor, which has curved cells.

FIG. 2 shows the same cell rotor 1 according to FIG. 1 in a side view. Coriolis forces, inter alia, occur during a radial motion in a rotating system. By means of appropriate curvature of the rotor cells 2 in the peripheral direction, as can be seen particularly well from FIG. 2, it is possible to compensate completely or partially for these Coriolis forces, or for the mixing processes caused by them, for individual phases of the energy exchange process. It is then important that the curvature of the rotor cells 2 should be curved against in the direction of rotation so that the postulate quoted above can be satisfied. In this configuration of the cell rotor 1, large differences in thermal expansion occur between the relatively hot rotor casing 1*a* and the relatively cool hub 3. This can be compensated by a so-called elastic configuration of the connecting elements which are shaped in such a way that they are only flexible with respect to radially symmetrical expansions of the cell rotor and the stress peaks can be displaced from the hot region into the cool region. This design has, firstly, the advantage that the hub 3 can be kept cool and that, therefore, only the tubular casing 1*a* has to be manufactured from a heat-resistant material. In addition, the expansion coefficients of the materials used can be different. Furthermore, very rapid temperature changes (e.g. changes to the operating condition or emergency shut-down) can be dealt with without stress problems because it is not necessary to wait for the temperature to even out. Furthermore, this connection is very stiff with respect to all deformations which are not radially symmetrical, so that there are no additional natural frequency problems. The geometry of the connecting elements 4 (spokes) should be selected in such a way that:

a) The stresses due to centrifugal force and different thermal expansions are superimposed on the cool hub whereas they partially compensate for one another on the hot cell rotor 1.

b) At the outer connecting point (cell rotor), the thermal stress should be approximately half as large as the centrifugal stress.

This ensures that, commencing from a starting condition (cold cell rotor at rated speed), the stress at the hub 3 increases with increasing cell rotor temperature and that at the cell rotor 1 decreases. This takes account of the decreasing load-carrying capacity of the material with increasing temperature. By means of the particular choice of the ratio of thermal stress to centrifugal stress, it is possible to ensure that the stress level at the outer connecting point for a hot cell rotor 1 over the complete speed range does not exceed half the value of the centrifugal stress. This is particularly important in the case of emergency shut-down and in machines which are subject to strong fluctuations during operation, such as is the case where the cell rotor 1 is employed as the pressure wave machine in an engine-driven vehicle.

These connecting elements 4 designed as spokes join the hub 3 tangentially so that the shape of these spokes 4 is kept curved as far as the rotor casing 1*a*. Owing to the technical stress considerations mentioned above, the curvature is preferably to be kept curved in the direction of rotation $\omega$ of the rotor 1. The number and material thickness of the spokes 4 depend on the particular size of the rotor 1 and on the dynamic forces to which the rotor 1 is subjected.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. Rotor of a pressure wave machine with cells arranged evenly distributed at its periphery which are intended to accept two gaseous media during operation for the purpose of compressing the first by means of pressure waves of the second medium, wherein the rotor cells extend in a plane normal to the axis of rotation of the rotor, wherein the rotor has a hub whose connection to the rotor casing of the rotor can be produced by spokes which meet the hub tangentially, wherein the spokes are curved in the direction of rotation.

2. Rotor as claimed in claim 1, wherein the rotor cells are curved against the direction of rotation.

* * * * *